United States Patent [19]

Doelfel

[11] Patent Number: 4,788,723

[45] Date of Patent: Dec. 6, 1988

[54] CLIP ON BELT LOOPS FOR CLOTHING

[76] Inventor: John G. Doelfel, 103 Kirtland Dr., Naples, Fla. 33942

[21] Appl. No.: 107,055

[22] Filed: Oct. 13, 1987

[51] Int. Cl.[4] ..... A41F 17/02

[52] U.S. Cl. ..... 2/271; 2/236

[58] Field of Search ..... 2/271, 236, 229

[56] References Cited

U.S. PATENT DOCUMENTS

| | | | |
|---|---|---|---|
| 403,220 | 5/1889 | Sanders | 2/271 |
| 673,741 | 5/1901 | Thomas et al. | 2/271 |
| 1,436,277 | 11/1922 | Manning et al. | 2/236 |

FOREIGN PATENT DOCUMENTS

| | | | |
|---|---|---|---|
| 2707896 | 8/1978 | Fed. Rep. of Germany | 2/271 |
| 2815536 | 10/1979 | Fed. Rep. of Germany | 2/271 |
| 2371160 | 7/1978 | France | 2/271 |

*Primary Examiner*—Werner H. Schroeder
*Assistant Examiner*—Jeanette E. Chapman
*Attorney, Agent, or Firm*—Merrill N. Johnson

[57] ABSTRACT

A clip-on belt loop assembly for fastening onto the waistband of a garment having no integral belt loops. The assembly includes a rigid elongated flat base plate having near its upper end a flange projecting from the base plate, a belt loop made of flexible material such as leather or fabric, and a clip such as used to fasten suspenders to the waistband of a garment. The ends of the belt loop are riveted or otherwise fastened to the opposite ends of the base plate. The clip is fastened to the upper end of the base plate preferably by the same rivet used to fasten the upper end of the belt loop to the base plate.

4 Claims, 1 Drawing Sheet

CLIP ON BELT LOOPS FOR CLOTHING

BACKGROUND AND SUMMARY OF THE INVENTION

The present invention relates to articles of clothing such as pants and skirts with a waistband which does not have integral belt loops but which may be worn with a waist-encircling belt. I have invented a belt loop assembly which can be simply and easily clipped onto the waistband of a pair of pants or a skirt in order to accomodate and contain a belt.

For many years great numbers of men's and women's pants and slacks and also women's skirts have been and are being marketed without belt loops. In recent years it has become fashionable to wear ornamental belts with pants or skirts which are not provided with integral belt loops.

In order to provide control over the positioning of a belt about the waist of a person whose pants or skirt has no integral belt loops, one or more of my unique belt loop assemblies can be readily clipped onto the waistband. And when the belt loops have served their purpose, they can be just as easily unclipped and removed.

My belt loops may be fashioned of fabric, leather, a suitable flexible plastic material or even metal. The opposite ends of the belt loop are attached to the opposite ends of an elongated rigid base plate. The base plate has a belt-engaging flange which projects at right angles from the front face of the base plate near its upper end. This flange prevents the belt from riding up beyond the upper edge of the waistband of the pants or skirt. A toggle-operated clip such as conventionally used to fasten suspenders to the waistband of a garment is securely attached to the rear face of the base plate preferably by the same means used to fasten the upper end of the belt loop to the base plate.

BRIEF DESCRIPTION OF THE DRAWINGS

Referring now to the drawings which depict a preferred embodiment of my invention.

DETAILED DESCRIPTION OF A PREFERRED EMBODIMENT

Figure 1:
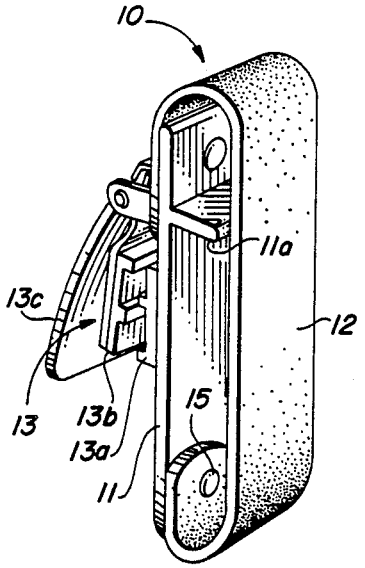
FIG. 1 is a perspective view of a preferred embodiment of my belt loop assembly.

The drawings illustrate a preferred embodiment of my clip-on belt loop assembly. Assembly 10 includes three major components, namely, base plate 11, belt loop 12 and clip 13 which are joined together by rivets 14 and 15.

Base plate 11 is a flat elongated strip of rigid material preferably a light weight metal or high density thermoplastic. The plate is an elongated rectangle and includes a belt-engaging flange 11*a* which projects at right angles from the front face of the base plate near the upper end of the plate. The purpose of flange 11*a* is to engage the upper edge of the belt and thus prevent the belt from riding up beyond the upper edge of the waistband of the garment to which belt loop assembly 10 is attached.

Belt loop 12 may be made of any suitable fabric, leather, synthetic plastic material or even metal. The material may be a plain woven fabric or a highly decorated flexible synthetic material or a strip of tooled and polished leather. The width of belt loop 12 is preferably equal to or somewhat greater than the width of base plate 11 and its length is sufficient to create a loop from the upper and lower ends of plate 11 plus the length necessary to permit the ends of belt loop 12 to be securely riveted or otherwise fastened to plate 11 near its opposite ends.

Clip 13 is a toggle-operated clip as conventionally used to fasten suspenders to the waistband of a pair of pants. The clip consists of three interconnected parts, namely, outer clip half 13*a*, inner clip half 13*b* and toggle 13*c* whose operation serves to open and close the fabric-gripping jaws of clip halves 13*a* and 13*b*.

Figure 2:
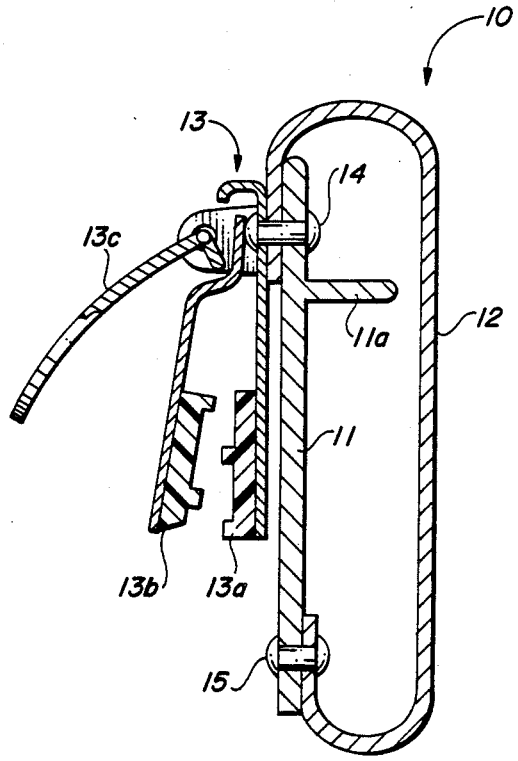
FIG. 2 is a side view partially broken away of the belt loop assembly shown in FIG. 1.
Figure 3:
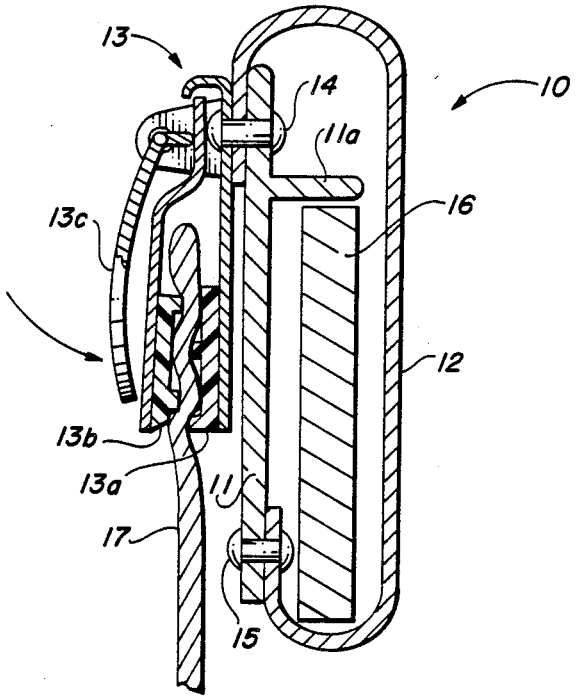
FIG. 3 is a side view of the belt loop assembly shown in FIGS. 1 and 2 attached to the waistband of a garment and with a belt inserted through the belt loop.

The lower end of belt loop 12 is fastened to the lower end of base plate 11 by rivet 15 as best shown in FIGS. 2 and 3. The upper end of belt loop 12 is fastened to the upper end of base plate 11 by the same rivet 14 which also fastens clip half 13*a* to the upper end of the rear face of plate 11.

A plurality of belt loop assemblies 10 are spaced about and clipped on to the waistband of a garment 17 as shown in FIG. 3. A belt 16 may then be threaded through the loop of each assembly 10 to provide control over the position of the belt and to permit the belt to provide positive support for the garment 17.

As shown in FIG. 3 the flange 11*a* intercepts the upper edge of belt 16, thus preventing the belt from riding up beyond the upper edge of the garment 17.

While I have shown in the drawings and have described a preferred embodiment of my unique belt loop assembly, no limitation of my invention should be implied from such description since the spirit and scope of the invention is limited only by the appended claims.

I claim:

1. A belt loop assembly for engaging a belt encircling the waistband of a garment comprising a rigid elongated generally rectangular base plate whose length is several times its width, said base plate having front and back faces and upper and lower ends, an elongated strip of flexible material having a width at least equal to that of the base plate and a length greater than the base plate whose opposite ends are securely fastened respectively to the upper and lower ends of the base plate to form an elongated belt loop, the uppermost portion of the elongated belt loop extending above any other portion of the assembly, and self-contained means securely attached to the rear face of the base plate for removably fastening the base plate and flexible belt loop to the waistband of a garment.

2. A belt loop assembly as set forth in claim 1 wherein the self-contained fastening means is a toggle-operated clip.

3. A belt loop assembly as set forth in claim 1 wherein the base plate includes on its front face and near its upper end an extended flat-faced flange projecting at 90° to the front face of the base plate to engage the upper edge of the belt.

4. A clip-on belt loop assembly for attachment onto the waistband of a garment comprising a rigid rectangular base plate whose length is several times its width, said base plate having front and rear faces and upper and lower ends and a flange projecting at right angles from it front face near its upper end, an elongated strip of flexible fabric having a width at least equal to that of said base plate and a length greater than said base plate whose opposite ends are securely fastened respectively to the upper and lower ends of said base plate to form an elongated flexible belt loop, and a toggle-operated clip securely fastened to the rear face of said base plate near its upper end for removeably fastening the belt loop assembly to the waistband of a garment.

* * * * *